US006910672B2

(12) United States Patent
Hufnagel

(10) Patent No.: US 6,910,672 B2
(45) Date of Patent: Jun. 28, 2005

(54) CORNER ASSEMBLY

(76) Inventor: Steve Hufnagel, 4400 N. Tallman Rd., Fowler, MI (US) 48835

( * ) Notice: Subject to any disclaimer, the term of this patent is extended or adjusted under 35 U.S.C. 154(b) by 407 days.

(21) Appl. No.: 10/121,276

(22) Filed: Apr. 12, 2002

(65) Prior Publication Data

US 2003/0146366 A1 Aug. 7, 2003

Related U.S. Application Data

(60) Provisional application No. 60/354,671, filed on Feb. 5, 2002.

(51) Int. Cl.[7] ..... E04G 15/06

(52) U.S. Cl. ..... 249/35

(58) Field of Search ..... 52/741.13, 741.14, 52/741.15, 745.12; 249/34, 4, 5, 6, 8, 35, 33

(56) References Cited

U.S. PATENT DOCUMENTS

| | | | | | |
|---|---|---|---|---|---|
| 2,021,210 | A | * | 11/1935 | Thorn | 249/35 |
| 2,511,829 | A | * | 6/1950 | Arrighini et al. | 249/35 |
| 2,532,246 | A | * | 11/1950 | Shuter | 249/34 |
| 4,038,798 | A | | 8/1977 | Sachs | 52/309 |
| 4,239,173 | A | | 12/1980 | Sawyer | 249/41 |
| 4,570,896 | A | | 2/1986 | Strickland et al. | 249/27 |
| 4,976,401 | A | | 12/1990 | Carlson | 249/194 |
| 5,038,541 | A | | 8/1991 | Gibbar, Jr. | 52/295 |
| 5,156,753 | A | * | 10/1992 | Speidel | 249/5 |
| 5,207,931 | A | * | 5/1993 | Porter | 249/34 |
| 5,230,907 | A | | 7/1993 | Strickland | 425/107 |
| 5,761,894 | A | | 6/1998 | Evans | 56/320.1 |
| 5,992,812 | A | | 11/1999 | Mark | 248/345.1 |
| 6,044,614 | A | * | 4/2000 | Bryant | 249/34 |
| 6,223,485 | B1 | | 5/2001 | Beck et al. | 52/239 |
| 6,305,134 | B1 | | 10/2001 | Robinson | 52/299 |
| 6,568,651 | B2 | * | 5/2003 | Reid | 249/44 |

* cited by examiner

*Primary Examiner*—Michael Safavi
(74) *Attorney, Agent, or Firm*—Howard & Howard

(57) ABSTRACT

A construction form 10 for forming a concrete wall having an acute female corner 26 includes an outer wall 14, an inner wall 16, an intermediate wall 18 defining an inside corner 20 and an outside corner 22. The form 10 includes a corner assembly 12 mounted to the inner wall 14 by fasteners 30 which allow separation of the inner 14 and outer 16 walls from the corner assembly 12. Thereafter, the corner assembly 12 is movable in any radial direction within the female corner 26.

10 Claims, 4 Drawing Sheets

CORNER ASSEMBLY

CROSS-REFERENCE TO RELATED APPLICATIONS

This application claims the benefit of U.S. Provisional Patent Application Ser. No. 60/354,671, filed Feb. 5, 2002.

FIELD OF THE INVENTION

The present invention generally relates to construction forms for pouring concrete and, more particularly, to wall forms having corners.

BACKGROUND OF THE INVENTION

Form assemblies for pouring concrete walls, and brick seats are well known. Typically, a form assembly includes a pair of forms spaced apart and linked by form ties. Liquid concrete is poured between the forms and allowed to cure or harden, thereby forming a concrete wall. The thickness of the concrete walls can be adjusted by the selection and utilization of form ties of appropriate length. Typical forms are constructed of plywood, steel or aluminum and are stripped from the concrete wall after the concrete has cured.

Typically, prefabricated form components are used in the construction of a form assembly. Generally, it is understood by those skilled in the art that the size of the form component used to construct form assemblies vary depending on the application for which the form assembly will be used.

In conventional concrete wall construction, the form assembly is assembled at a job site. These form assemblies are often custom-built from wooden studs sheathed with plywood for one-time use. Advantageously, on larger construction sites, reusable mobile form assemblies are used, typically ganged together and shifted as the height and length of the concrete wall is increased.

When the structure wall is irregular to present an inside corner, the form assembly to define that inside corner is often complex but more importantly, it is frequently difficult to remove the construction form from the inside corner. In other words, after the structure wall is self supporting where the construction form can be removed, the corner assembly of the form frequently has an interference fit, thereby making it difficult to remove the construction form from the structure wall. In particular, the forces created at an inside corner of a form, such as when pouring a concrete wall having a pier or a column, may be significant, thereby causing the removal of the corner assembly from the structure to be time consuming and labor intensive. In addition, constructing a structure having an inside corner generally requires several components configured together in order to achieve the desired configuration of the structure.

SUMMARY OF THE INVENTION AND ADVANTAGES

The subject invention provides a corner assembly for a construction form. The assembly includes an outer wall and an inner wall spaced from the outer wall. An intermediate wall extends between the outer wall and the inner wall and defines an inside corner at the juncture thereof with the intermediate wall. The intermediate wall also defines an outside corner at the juncture thereof with the inner wall. Portions of the intermediate wall and the inner wall define a corner assembly separable from the outer and inner walls to allow the outer and inner walls to be removed from a female corner in a formed construction wall formed therein without removing the corner assembly from the acute female corner of the construction wall.

The corner assembly of the present invention enables a construction form to remain intact and be easily removed from a structure formed therein having the female corner, thereby substantially reducing labor, time and materials required to erect, remove, and re-erect the construction form.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
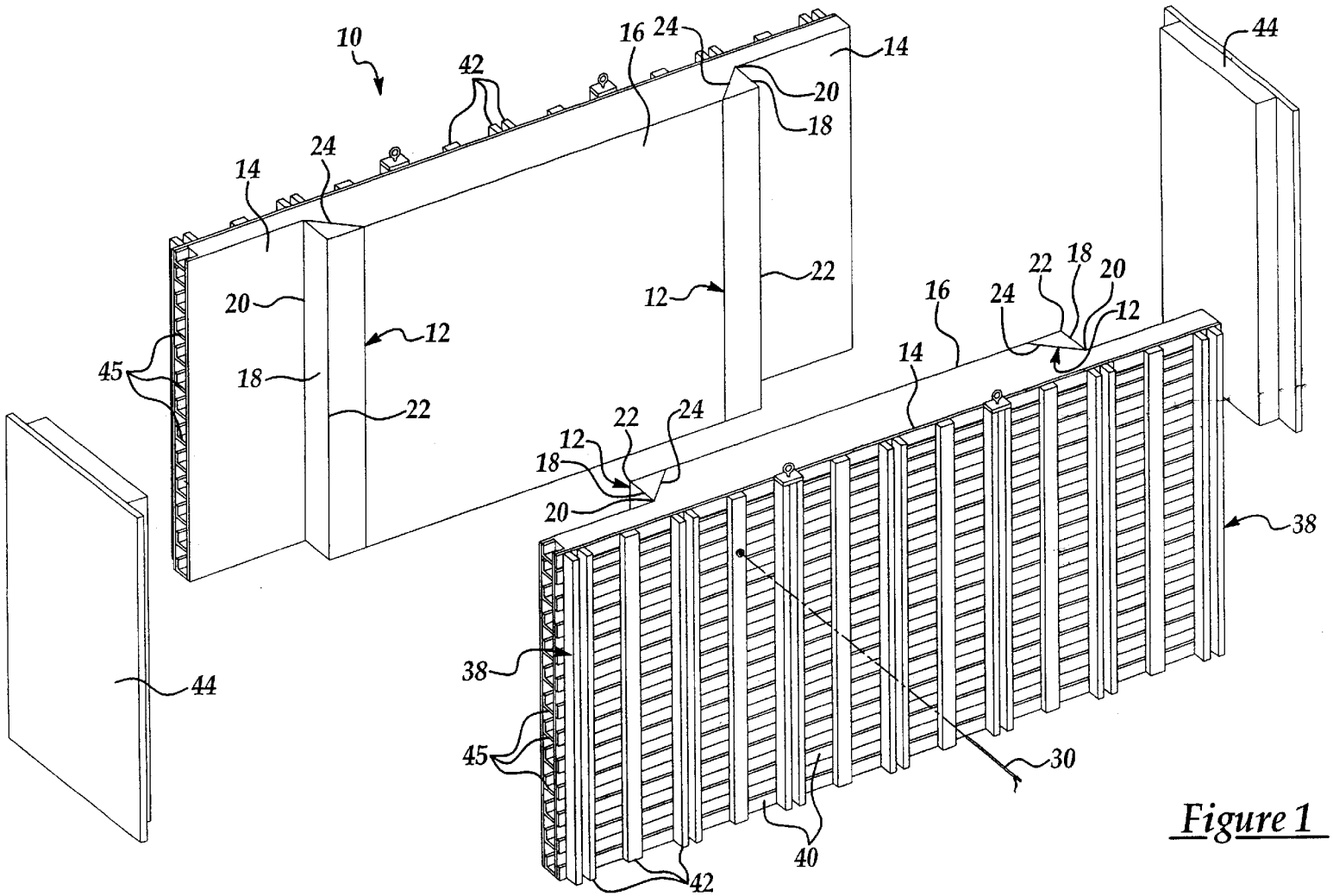
FIG. 1 is an exploded perspective view of a construction form utilizing the corner assembly of the present invention.

Referring to the Figures, wherein like numerals indicate like or corresponding parts throughout the several views, a construction form is generally shown at 10 and includes the corner assembly of the subject invention, generally indicated at 12.

The construction form 10 includes an outer wall 14 and an inner wall 16 that is parallel to and spaced apart from the outer wall 14. An intermediate wall 18 extends between the outer wall 14 and the inner wall 16 to define an inside corner 20 at the juncture of the intermediate wall 18 and the outer wall 14. The intermediate wall 18 may extend perpendicularly from the outer wall 14 or any other suitable angle. The intermediate wall 18 also defines an outside corner 22 at the juncture of the intermediate wall 18 and the inner wall 16. The intermediate wall 18 extends from the inside corner 20 at the outer wall 14 to the outside corner 22 at the inner wall 16. The outer wall 14 may be integrally formed with the inner wall 16 or the outer and inner walls 14, 16 may be built separately and mounted together.

Portions of the intermediate wall 18 and the inner wall 16 define the corner assembly 12 which is separable from the outer and inner walls 14, 16 along a diagonal interface 24. Also that portion of the inner wall 16 defining the corner assembly 12 is equal in length to the entire length of the intermediate wall 18; however, it is to be understood that the length of the portion of the inner wall 16 defining the corner assembly 12 may be equal to, longer or shorter than that portion of the intermediate wall 18 defining the corner assembly 12. The corner assembly 12 is independent from and separates from the inner and outer walls 16, 14 along the diagonal interface 24 extending between the intermediate wall 18 at the inside corner 20 and the inner wall 16. In other words, the diagonal interface 24 is disposed at a forty-five degree angle and consumes all of the intermediate wall 18, as shown, but may be at different angles to vary the length of the relative portions of the intermediate 18 and inner walls 16 which define each corner assembly 12. Although the corner assembly 12 includes the entire intermediate wall 18 from the inside corner 20 at the outer wall 14 to the outside corner 22 at the inner wall 16, it will be appreciated that only a portion of the intermediate wall 18 need be included in the corner assembly 12, i.e., the diagonal interface 24 would be spaced from the inside corner 20. The corner assembly 12, may be integrally formed with either one of the inner or outer walls 16, 14 or both. Moreover, the corner assembly 12 may be removably mounted to either one of the inner and outer walls 16, 14 or both.

Figure 3:
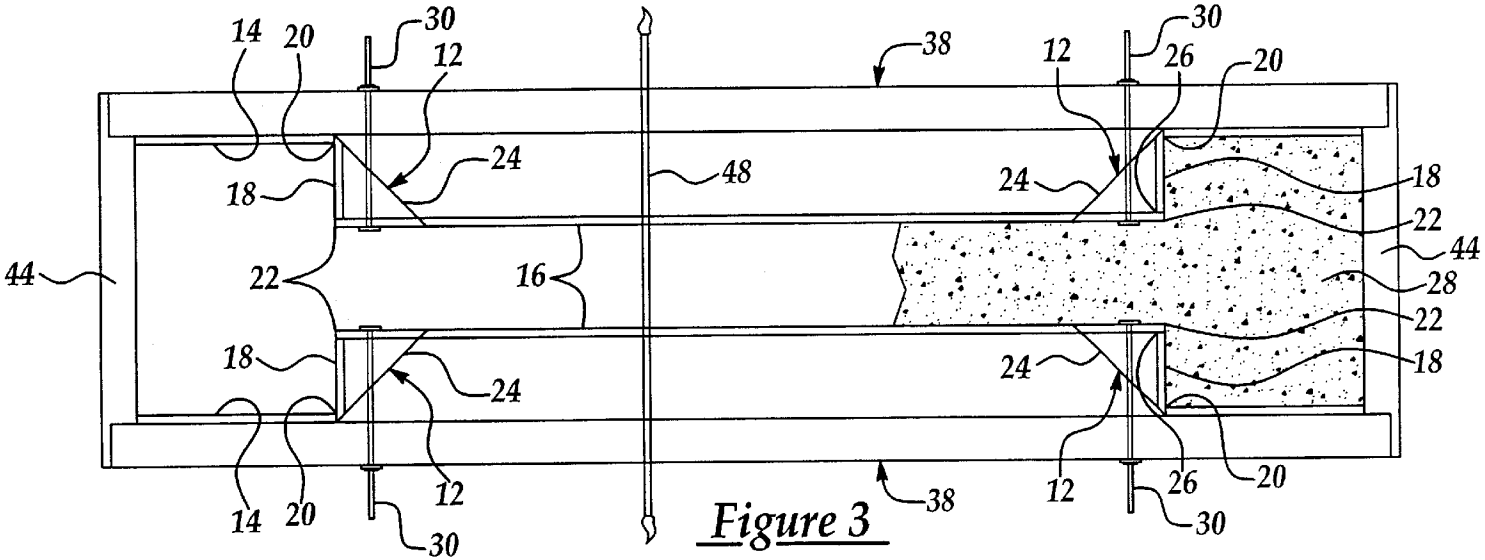
FIG. 3 is a top view of the construction form of FIG. 1 thereunto showing two corner assemblies of the subject invention facing in opposite directions.

The assembly 10 includes a lost motion device comprising a plurality of fasteners 30 interconnecting each corner assembly 12 and the outer wall 14. The fasteners 30 may include a plurality of threaded bolts, screws, and nuts or the like. Each fastener 30 is disposed through the rear of the outer wall 14 so as to be accessible therefrom. The fastener 30 extends through the interface 24 and into the associated corner assembly 12. As shown in FIG. 3, concrete is poured into the construction form 10 to form a concrete wall 28 having an acute female corner 26, as formed and defined by the corner assembly 12. Each fastener 30 interconnects a corner assembly 12 and the outer wall 14 such that the corner assembly 12 may be removed from being wedged into the acute female corner 26 of the concrete wall 28 after the outer wall 14 is disconnected via the fasteners 30 from the corner assembly 12. As will be appreciated, the lost motion device 30 may be a slideable member or any other suitable type of quick disconnect (not shown) interconnecting the walls 14, 16 and each corner assembly 12.

During the fabrication of the construction form 10, the fasteners 30 are tightened to hold each corner assembly 12 and the inner and outer walls 16, 14 together. Once the concrete wall 28 is set, the fasteners 30 are loosened to allow the corner assemblies 12 to remain wedged in the acute corner 26 of the concrete wall 28 thereby permitting the outer and inner walls 14, 16 to be pulled away. Once the outer 14 and inner 16 walls are free and spaced from the concrete wall 28, the corner assembly 12 is free to move in any direction within the acute angle of the acute corner 26 in the concrete wall 28.

Figure 2:
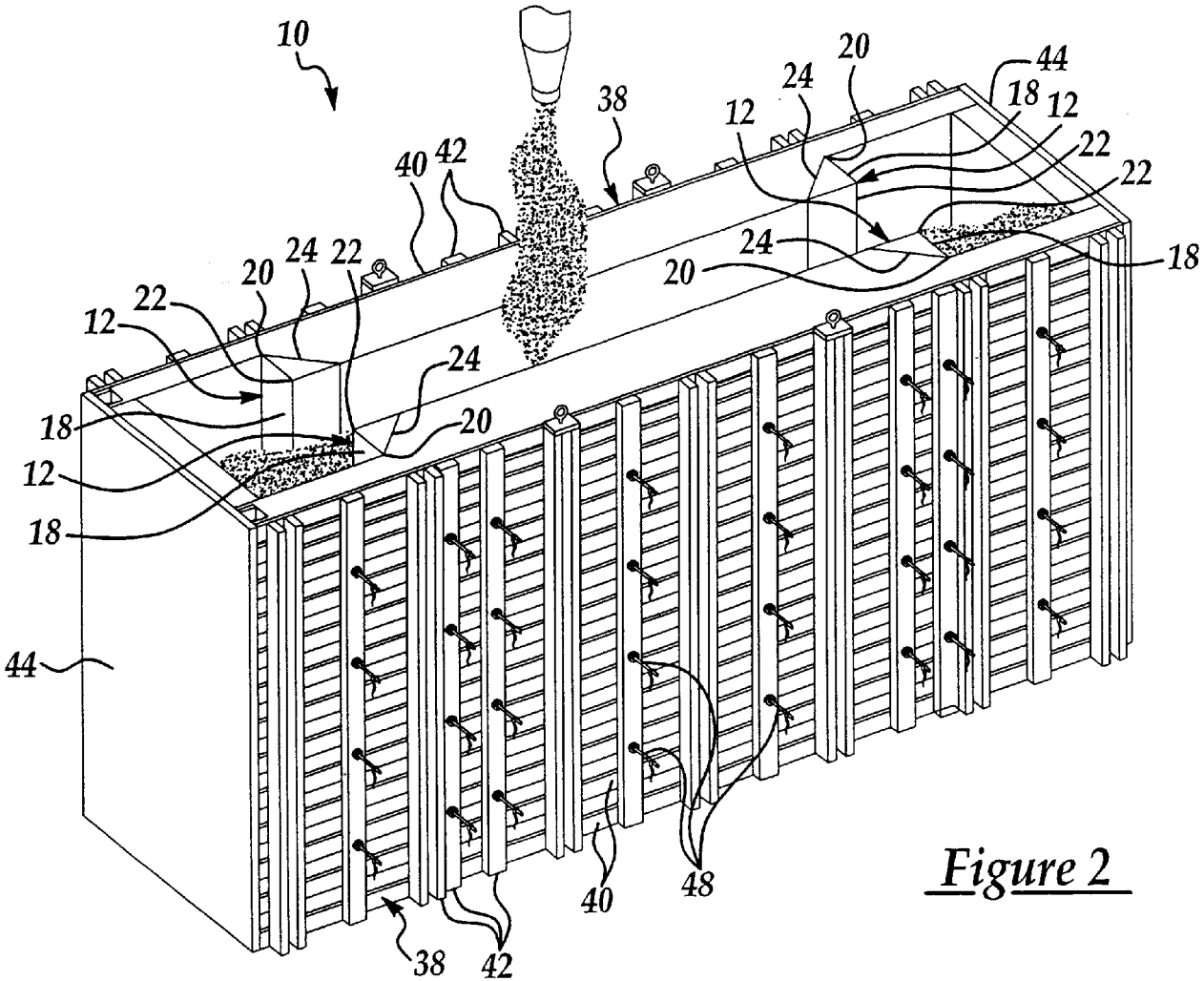
FIG. 2 is a perspective view of the construction form assembly of FIG. 1 with cement being poured thereto.
Figure 4:
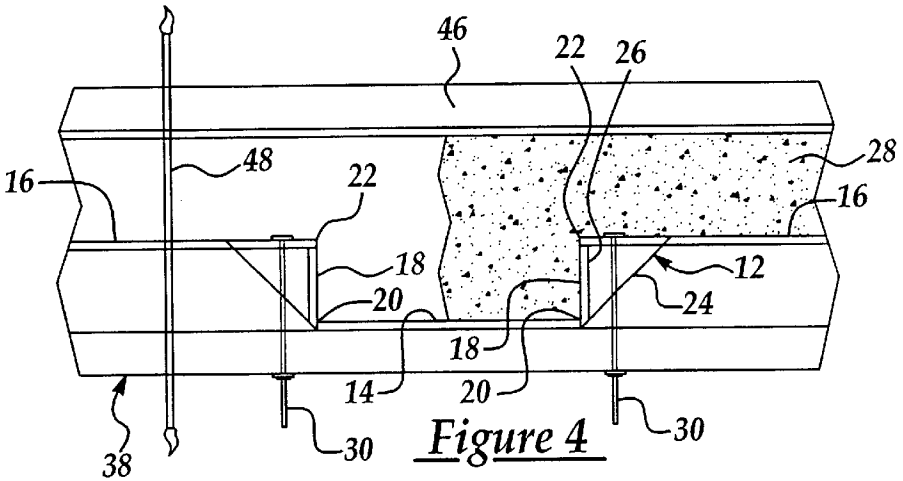
FIG. 4 is a fragmenting top view of construction form similar to FIG. 1 but showing two facing corner assemblies of the subject invention.
Figure 5:
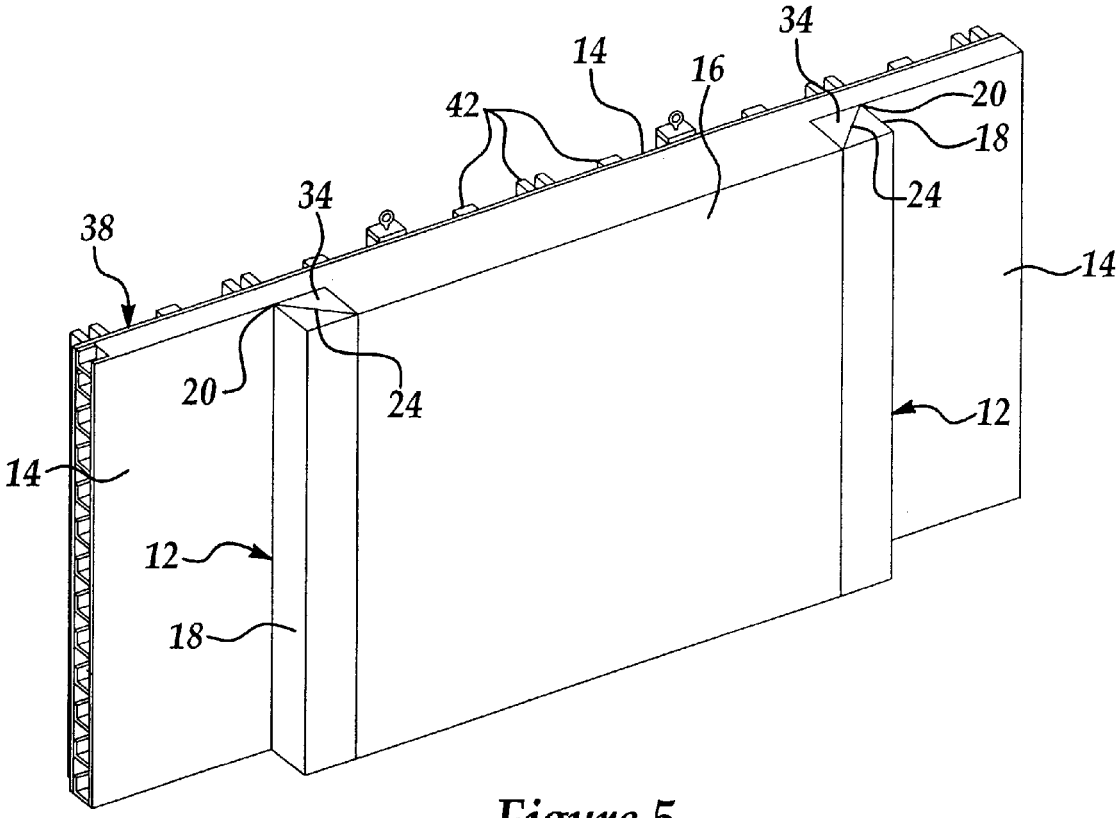
FIG. 5 is a perspective view of the construction form of the present invention.

In the arrangement of FIGS. 1–3, the corner assemblies 12 are disposed at opposite ends of the inner wall 16, i.e., the corner assemblies 12 face away from one another. In the arrangement of FIG. 4, a pair of corner assemblies 12 are spaced from one another and are mirror images of one another. In yet another arrangement as shown in FIG. 5, corner assemblies 12 are disposed on the construction form 10 with a complimentary corner component 34 so as to define a recess in the concrete wall. The corner assemblies 12 of FIG. 5 may be placed on the custom corner components 34 and are connected thereto with the lost motion fastener 30.

The outer 14 and inner 16 walls are structurally part of a form wall, generally indicated at 38, comprising horizontally extending backing boards or plywood sheets 40 and vertically extending stringers 42. Horizontal planks or channels 45 extend between the boards 40 and the outer 14 and inner 16 walls. In the arrangement of FIGS. 1–3, two such form walls 38 are parallel and spaced from one another to define a space for receiving concrete and forming the concrete wall 28. The ends of the form walls 38 are interconnected by end walls 44. The arrangement of FIGS. 4 and 5 differ by utilizing only one form wall 38 with the corner assemblies 12 attached thereto and a plain back wall 46. The corner assembly 12, the outer and inner walls 14, 16 and the intermediate wall 18 and/or the entire form wall 38 may comprise wood, steel, plastic or any other suitable material. A tie 48 is disposed between the spaced form walls 38 to hold the construction form 10 together. The back wall 46 is spaced from the outer 14 and inner 16 walls to define a forming cavity therebetween. However, as shown in FIGS. 1–3, instead of a plain back wall 46 two form walls 38 may be spaced apart to define cavities by the outer 14 and inner 16 walls facing one another. In either case, ties 48 having first and second ends are disposed between one of the inner 16 and outer 14 walls and the back wall 46 or like form wall 38 to retain the spaced walls. A tie 48 is disposed between the spaced form walls 38 to hold the construction form 10 together.

Once the construction form 10 is fabricated, the concrete or other structural material is disposed in the cavity against the inside of the walls 14, 16, 18 to form a structure wall 28. The structural material may be liquid concrete, bricks or any other suitable material. As the structural material is introduced into the construction form 10 and cures to form the structure wall 28, a wedging force is exerted on the corner assemblies 12 which inhibits removal of the corner assemblies 12. Accordingly, the fasteners 30 are loosened which allows the outer 14 and inner 16 walls to be moved a slack distance from each corner assembly 12 leaving the corner assembly 12 wedged into the acute angle 26 of the formed concrete wall 28. With the inner 14 and outer 16 walls spaced from the corner assembly 12, the corner assembly 12 may be moved in any direction radially within the acute angle of the acute corner 26 for easy removal.

The invention has been described in an illustrative manner, and it is to be understood that the terminology that has been used is intended to be in the nature of words of description rather than limitation. It will be apparent to those skilled in the art that many modifications and variations of the present invention are possible in light of the above teachings. Therefore, it is to be understood that the invention may be practiced otherwise than as specifically described within the scope of the amended claims.

What is claimed is:

1. A construction form assembly comprising;

an outer wall (14);

an inner wall (16) spaced from and parallel to said outer wall;

said inner and outer walls being connected for support and movement together as a form, an intermediate wall (18) extending between said outer wall (14) and said inner wall (16) to define an inside corner (20) at the juncture thereof with said outer wall (14) and to define an outside corner (22) at the juncture thereof with said inner wall (16) portions of said intermediate wall (18) and said inner wall (16) defining a first corner assembly (12) separable from said outer (14) and inner (16) walls and the connection therebetween to allow said outer (14) and inner (16) walls to be removed from an acute female corner (26) in a formed construction wall (28) formed therein independently of removal of said first corner assembly (12) from the acute female corner of the construction wall.

2. An assembly as set forth in claim 1 including a lost motion device (30) interconnecting said first corner assembly (12) and said outer wall (14) to remove said first corner assembly (12) from the acute female corner (26) after said outer wall (14) is removed from the acute female corner (26).

3. An assembly as set forth in claim 2 wherein said portion of said intermediate wall (18) includes the entire intermediate wall (18) from said inside corner (20) at said outer wall (14) to said outside corner (22) at said inner wall (18).

4. An assembly as set forth in claim 3 wherein said portion of said inner wall (18) defining said first corner assembly (12) is equal in length to the entire length of said intermediate wall (18).

5. An assembly as set forth in claim 4 wherein said first corner assembly (12) separates from said inner (16) and outer walls (14) along an interface interconnecting and extending between said intermediate wall (18) at said inside corner (20) and the extremity of said inner wall (16) portion spaced from the juncture thereof with said intermediate wall (16).

6. An assembly as set forth in claim 5 including a second corner assembly (12) spaced from and a mirror image of said first corner assembly (12).

7. An assembly as set forth in claim 6 wherein said first and second corner assemblies (12) extend in opposite directions.

8. An assembly as set forth in claim 6 wherein said first and second corner assemblies (12) extend toward one another.

9. An assembly as set forth in claim 6 wherein said walls (18) comprise one of wood, metal and plastic.

10. A construction form comprising:

a form wall (38) presenting an outer wall (14)

an inner wall (16) spaced from and parallel to said outer wall (14), and an interface (24) extending at an acute angle between said outer (14) and inner (16) walls and facing inwardly in the same general direction as said outer (14) and inner (16) walls;

a corner assembly (12) having a diagonal surface for mating engagement with said interface (24) and defining an outside corner (22); and a lost motion device (30) interconnecting said corner assembly (12) and said form wall (38) through said interface (24) for allowing said form wall (38) with said outer (14) and inner (16) walls to be removed while leaving said corner assembly (12) in a formed female corner.

* * * * *